United States Patent [19]

Harris

[11] Patent Number: 4,694,857

[45] Date of Patent: Sep. 22, 1987

[54] FUEL SENDER UNIT

[75] Inventor: Robert S. Harris, Connersville, Ind.

[73] Assignee: Stant Inc., Connersville, Ind.

[21] Appl. No.: 846,080

[22] Filed: Mar. 31, 1986

[51] Int. Cl.[4] ..... F04B 39/12

[52] U.S. Cl. ..... 137/565; 137/574; 417/360; 417/361; 417/363

[58] Field of Search ..... 137/565, 576, 574; 417/360, 361, 363, 365

[56] References Cited

U.S. PATENT DOCUMENTS

| | | | |
|---|---|---|---|
| 1,888,250 | 11/1932 | Tice | 123/497 |
| 2,084,605 | 6/1937 | Webb | 123/139 |
| 2,547,761 | 4/1951 | Korte | 222/385 |
| 2,963,203 | 12/1960 | Hoelle | 222/333 |
| 3,186,344 | 6/1965 | Hogeman | 103/54 |
| 3,193,151 | 7/1965 | Jeep, Jr. et al. | 222/180 |
| 3,269,378 | 8/1966 | Eifler et al. | 123/139 |
| 3,293,516 | 12/1966 | Maier et al. | 318/128 |
| 3,417,703 | 12/1968 | Eckert et al. | 103/41 |
| 3,485,226 | 12/1969 | Arendt et al. | 123/142.5 |
| 3,659,965 | 5/1972 | Ebert et al. | 417/363 |
| 3,873,243 | 3/1975 | Nusser et al. | 417/368 |
| 3,906,916 | 9/1975 | Laufer | 123/139 |
| 3,910,464 | 10/1975 | Schlanzky | 222/180 |
| 3,934,561 | 1/1976 | Romann et al. | 123/32 |
| 3,951,119 | 4/1976 | Jaggle et al. | 123/139 |
| 3,969,044 | 7/1976 | Fussner et al. | 417/410 |
| 3,974,809 | 8/1976 | Stumpp et al. | 123/139 |
| 4,041,921 | 8/1977 | Eckert et al. | 123/140 |
| 4,100,904 | 7/1978 | Eckert et al. | 123/139 |
| 4,160,625 | 7/1979 | Dyhr et al. | 417/363 |
| 4,162,745 | 7/1979 | Anderson, Jr. | 222/148 |
| 4,164,921 | 8/1979 | Hofer et al. | 123/139 |
| 4,168,690 | 9/1979 | Hofer | 123/139 |
| 4,213,434 | 7/1980 | Vogtmann et al. | 123/462 |
| 4,279,232 | 7/1981 | Schuster et al. | 123/516 |
| 4,306,530 | 12/1981 | Gmelin et al. | 123/461 |
| 4,326,487 | 4/1982 | Maisch et al. | 123/453 |
| 4,362,476 | 12/1982 | Kemmner et al. | 417/360 |
| 4,397,333 | 8/1983 | Liba et al. | 137/574 |
| 4,409,942 | 10/1983 | Eheim | 123/387 |
| 4,442,810 | 4/1984 | Eheim | 123/357 |
| 4,465,049 | 8/1984 | Eckert et al. | 123/446 |
| 4,467,762 | 8/1984 | Fischer et al. | 123/357 |
| 4,475,519 | 10/1984 | Eheim e al. | 123/502 |
| 4,498,334 | 2/1985 | Riesenberg | 73/113 |
| 4,569,637 | 2/1986 | Tuckey | 417/360 |

*Primary Examiner*—Alan Cohan
*Assistant Examiner*—John A. Rivell
*Attorney, Agent, or Firm*—Barnes & Thornburg

[57] ABSTRACT

A fuel sender unit is provided for delivering fuel from a conventional fuel tank that may have a resilient bottom wall of the type that deflects under a fuel load. The fuel sender unit includes a support fixture mounted on the fuel tank, a sending unit within the fuel tank for pumping fuel in the fuel tank toward a point of use outside the fuel tank, and an extension apparatus for coupling the sending means to the support fixture for relative movement therebetween. The extension apparatus includes a plurality of fluid-conducting telescoping guide tube assemblies. The sending unit includes a pump and a reservoir cup for accumulating an auxiliary supply of fuel within the fuel tank to maintain a substantially uninterrupted supply of fuel to the pump. The sending unit is lowerable to a variety of depths within the fuel tank to reach and pump fuel accumulating in various regions along the bottom fuel tank wall notwithstanding sagging deformation of said bottom wall. The extension apparatus is automatically adjustable using fuel pressure generated by the fuel pump and yieldably biases the pump and reservoir cup assembly against the bottom wall of a fuel tank during fuel pumping activity to maximize recovery of fuel from the fuel tank.

37 Claims, 3 Drawing Figures

FUEL SENDER UNIT

BACKGROUND AND SUMMARY OF THE INVENTION

This invention relates to fuel pumps, and particularly to a fuel sender unit that is submerged within the fuel tank of a vehicle. More particularly, this invention relates to a fuel sender unit that is automatically movable to reach lowermost regions of a vehicle fuel tank during fuel sending activity to maximize fuel recovery from the fuel tank.

Many vehicle fuel tanks, particularly those made of plastics material, tend to sag under a full fuel load. plastic fuel tanks are widely used on light duty trucks, vans, and also on some passenger cars. Over time, the permanent shape of such a deformable fuel tank changes as it is continually exposed to cyclic loading and stretched beyond its elastic limit. Fuel collecting in depressed regions of the fuel tank is often inaccessible to conventional fixed-position fuel pumps. Typically, conventional fixed-position fuel pump systems are unable automatically to reach and pump fuel that collects in these low-lying sagging regions of deformed fuel tanks.

Once installed, conventional fixed-position and extensible fuel pump systems are not easily adjusted to compensate for variation in fuel tank shape due to sag. Another problem is that conventional fixed position and ( extensible fuel pump systems are not easily converted for installation in fuel tanks of different sizes, shapes, and depths. Instead, it is generally necessary to produce a separate fuel pump system of a particular size matched to accommodate a fuel tank having a designated shape and size.

Interrupted fuel supply to a fuel pump is a another significant problem hampering operation of vehicles, especially those vehicles equipped with a fuel injection system. In particular, a vehicle fuel pump can suddenly go "dry" whenever the fuel level in the fuel tank is too low as a result of fuel sloshing and churning during swift vehicle cornering maneuvers or other agitation of the fuel tank. In conventional carbureted engine systems, the carburetor includes a fuel reserve float bowl for supplying fuel to the engine until the fuel pump resumes delivery of fuel from the fuel tank. By comparison, the engine in a vehicle having a fuel injection system will stop whenever the delivery of fuel from the fuel pump is interrupted. Serious accident or injury can result from a momentary lapse in engine operation caused by an interruption in the supply of fuel to the fuel pump.

A fuel sender apparatus adapted to reach and pump fuel collected in low-lying sagging regions of a fuel tank and also configured to accumulate fuel in an auxiliary fuel reservoir within the fuel tank to maintain an uninterrupted supply of fuel to the fuel pump would avoid serious shortcomings of conventional fuel pump systems.

According to the present invention, a fuel sender unit is provided for delivering fuel from a conventional fuel tank that may have a resilient bottom wall that deflects under a fuel load. The fuel sender unit includes a support fixture mounted on the fuel tank, sending means within the fuel tank for pumping fuel in the fuel tank toward a point of use outside the fuel tank, and extensible means for coupling the sending means to the support fixture for relative movement therebetween in response to fuel pressure generated during operation of the sending means. Thus, the sending means is lowerable to a variety of depths within the fuel tank to reach and pump fuel accumulating in various regions along the bottom fuel tank wall notwithstanding any sagging deformation of said bottom wall.

One feature of the present invention is the provision of extensible means for coupling the fuel sending means for relative movement within the fuel tank in response to fuel pressure generated during operation of the fuel sending means. This feature positively positions the fuel intake portion of the fuel sender unit to set flush on the bottom of the fuel tank. Thus, one fuel sender unit advantageously fits fuel tanks of different size. In addition, such an extension capability advantageously enables the sending means to reach and pump fuel accumulating in low-lying regions of a sagging fuel tank bottom wall while fuel is being pumped from the fuel tank. This feature greatly enhances operation of fuel sending units submerged in fuel tanks, particularly those fuel tanks tending to sag or change shape under a full fuel load.

In preferred embodiments, the sending means includes a reservoir cup for accumulating an auxiliary supply of fuel within the fuel tank and a fuel pump having its inlet in fluid communication with the reservoir cup. The reservoir cup is suspended in its various operating positions within the fuel tank by the extensible means. Fuel inlet means is provided in at least one of the cup walls so that fuel is admitted into the reservoir cup after the crest of fuel in the fuel tank has fallen to a level below a maximum capacity level established by an upper annular edge of the reservoir cup. It is important to keep the fuel pump "wet", i.e., in fuel. The reservoir is self-filling and stays full even when the vehicle is cornering and fuel is low.

The extensible means provides means for guiding the sending means along a path toward the bottom wall of the fuel tank. The guide means desirably includes a siphon tube for selectively conducting fuel from the reservoir cup to locations outside of the fuel tank and a return tube for delivering fuel to the reservoir cup from a source outside the fuel tank. In one embodiment, the return means interconnects a fuel injection system and a reservoir cup so that uncombusted fuel discharged by the fuel injection system during operation of the vehicle is returned to the reservoir cup for recirculation to the engine Fuel discharge means is provided for conducting fuel discharged from the pump outlet under pressure toward a point of use outside of the fuel tank. The fuel discharge means is configured to provide adjustment means for yieldably biasing the pump and reservoir cup assembly against the bottom wall of a fuel tank during fuel pumping activity to maximize recovery of fuel from the fuel tank.

Illustratively, the adjustment means includes a fixed hollow discharge tube extending through an aperture in the support fixture and a companion movable hollow discharge tube. An upper end of the movable discharge tube is slidably received within the fixed hollow discharge tube in telescoping relation and a lower end of said movable tube is rigidly connected to the pump outlet. The upper end of the movable discharge tube includes an annular biasing surface received in a hollow space in the fixed discharge tube. That hollow space is pressurized by fuel discharged under pressure therethrough by the pump.

In operation, pressurized fuel in the hollow space acts on the annular biasing surface to apply a downwardly-directed force causing the movable discharge tube to slide downward relative to the fixed discharge tube. This sliding movement lowers the pump and reservoir cup assembly, and in particular, the fuel inlet means of the reservoir cup, to a lowest operating position with the fuel tank in close proximity to the bottom wall of the fuel tank.

Additional features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Fuel sender unit 10 provides an easily serviceable snap-assembly fuel pumping means that is submersible within a fuel tank and automatically movable under pump pressure to a lowest possible depth within the fuel tank during fuel pumping activity. The novel fuel sender unit 10 is installable without modification in a wide variety of differently shaped fuel tanks. Moreover, the fuel sender unit 10 can reach and pump fuel amassed in sagging regions or low-lying pockets formed in the bottom wall of the fuel tank even though such fuel is normally inaccessible to conventional fixed-position or manually-movable fuel sending assemblies. In addition, the movable fuel pumping means is partially enclosed within its own travelling fuel reservoir to maintain a substantially uninterrupted supply of fuel to the fuel pumping means during all fuel pumping activity.

The fuel sender unit 10 includes a top mounting plate 12, fuel sending means 14, and guide means 16 for movably coupling the fuel sending means 14 to the top mounting plate 12. The fuel sender unit 10 is installable in a fuel tank having a top wall 18*a* and a bottom wall 18*b* as shown best in FIGS. 2 and 3. It will be appreciated by those skilled in the art that while bottom walls of fuel tanks are known to sag under fuel loading as shown in FIG. 3, thereby forming scattered pockets or other fuel-collecting depressions, such conditions in no way form an actual part of the present invention and need not necessarily be extant to ensure successful and advantageous operation of fuel sender unit 10.

Figure 1:
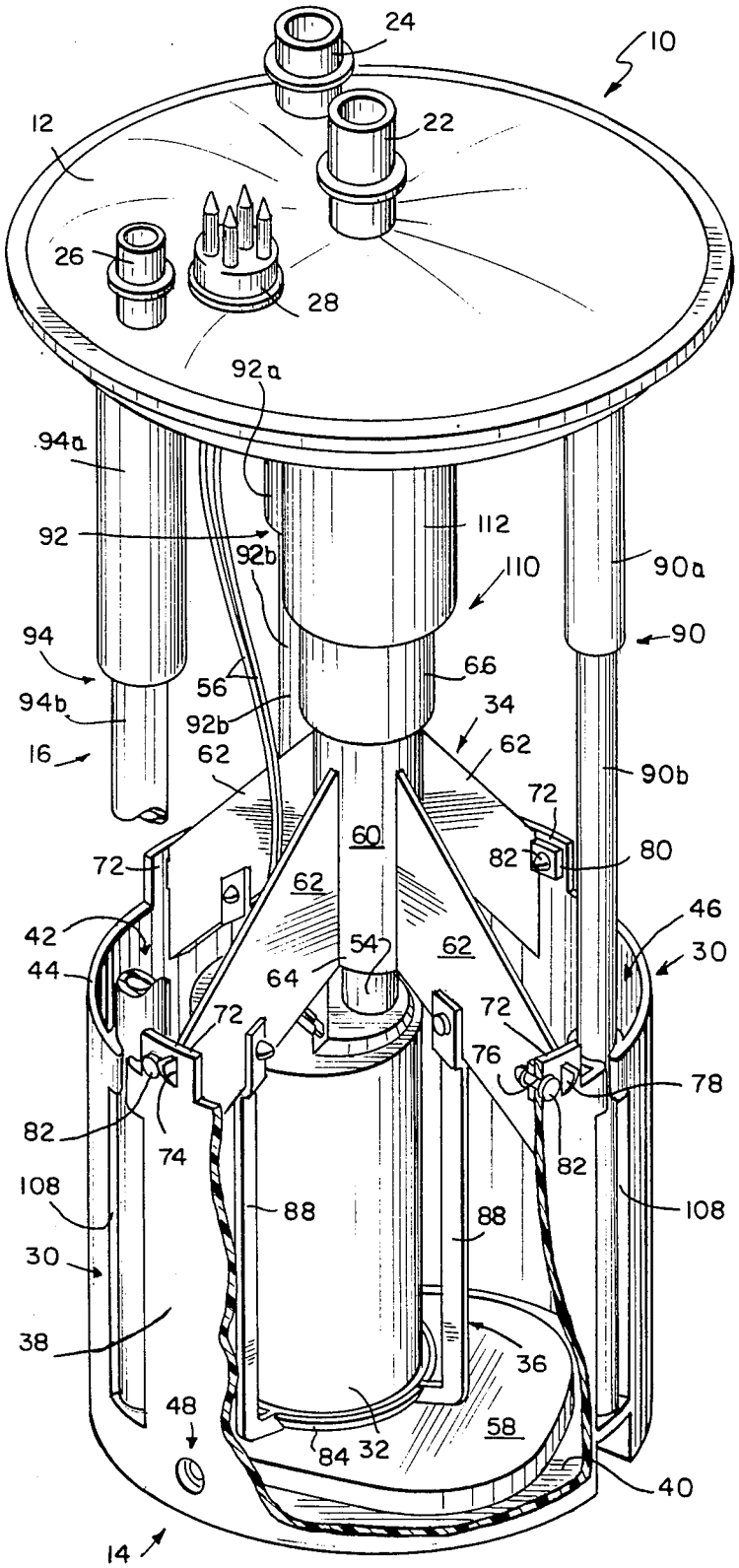
FIG. 1 is a perspective view of a preferred embodiment of the present invention with portions broken away to reveal the interior of a reservoir cup.

Referring to FIG. 1, top mounting plate 12 includes a primary outlet 22 for dispensing fuel from the fuel tank 18, a secondary outlet 24 through which fuel can be siphoned from the fuel tank 18, and an inlet 26 for returning unused fuel from a vehicle engine (not shown) to the fuel tank 18. Electrical wire harness connector 28 is fixed to top mounting plate 12 to permit an electric pump within fuel sending means 14 to be coupled electrically through plate 12 to a power source (not shown) situated elsewhere in the vehicle outside of fuel tank 18.

Fuel sending means 14 includes a reservoir cup 30, a fuel pump 32, an upper pump support frame 34, and a lower pump support frame 36. The reservoir cup 30 is preferably a cylindrical shell having a continuous side wall 38 and a flat bottom wall 40 cooperating to define hollow chamber 42. Upper annular edge 44 of side wall 38 defines an open mouth 46 providing one means for admitting fuel from fuel tank 18 into hollow chamber 42. During refueling activity, the crest of fuel in fuel tank 18 will rise to a height sufficient to overflow upper annular edge 44 and fill hollow chamber 42 with fuel.

One or more one-way inlet valves 48 are installed in bottom wall 40 or in a lowermost region of side wall 38 to provide another means for admitting fuel from fuel tank 18 into hollow chamber 42. Illustratively, one-way inlet valve 48 extends through side wall 38 in a region adjacent to bottom wall 40. One-way inlet valve 48 permits fuel to be admitted into reservoir cup 30 after the crest of fuel in fuel tank 18 has fallen to a level below the maximum capacity established by the upper annular edge 44 of the reservoir cup 30. It will be appreciated that one-way inlet valve 48 operates in the intended manner so long as the quantity of fuel in the fuel tank exceeds a predetermined minimum amount. That minimum amount is a function of the capacity and contour of the fuel tank, and also the location of inlet valve 48 in relation to the bottom wall 18*b* of the fuel tank.

Figure 2:
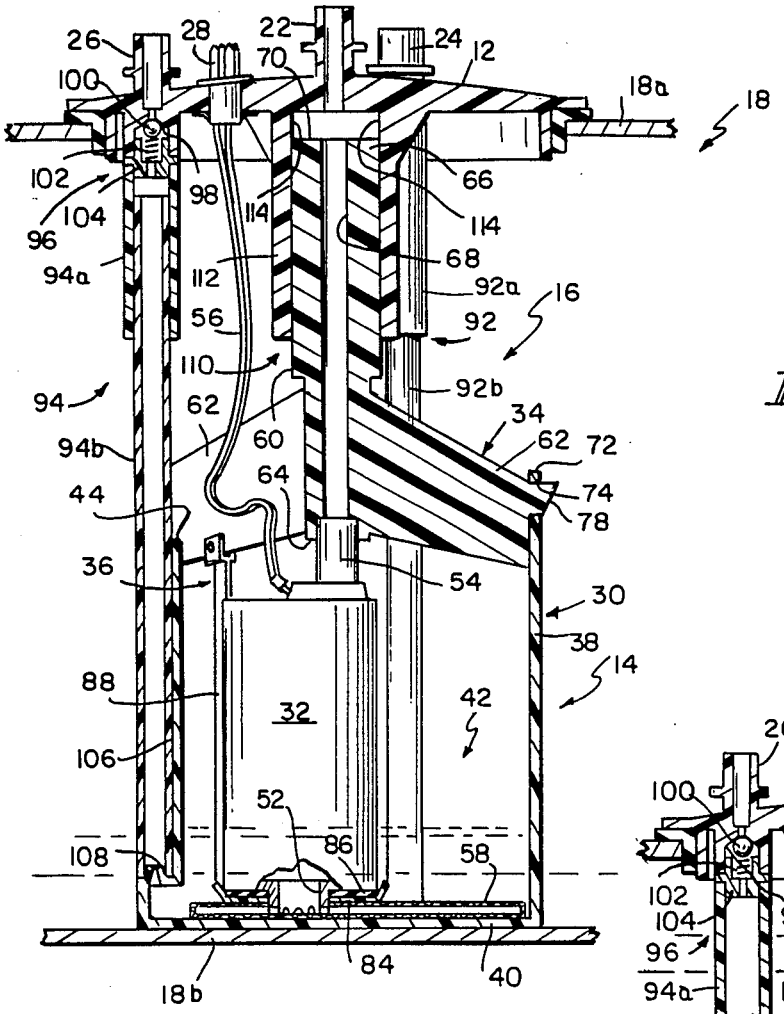
FIG. 2 is a transverse sectional view of the embodiment of FIG. 1 showing a fuel sender unit biased against the flat bottom wall of an undeformed fuel tank.
Figure 3:
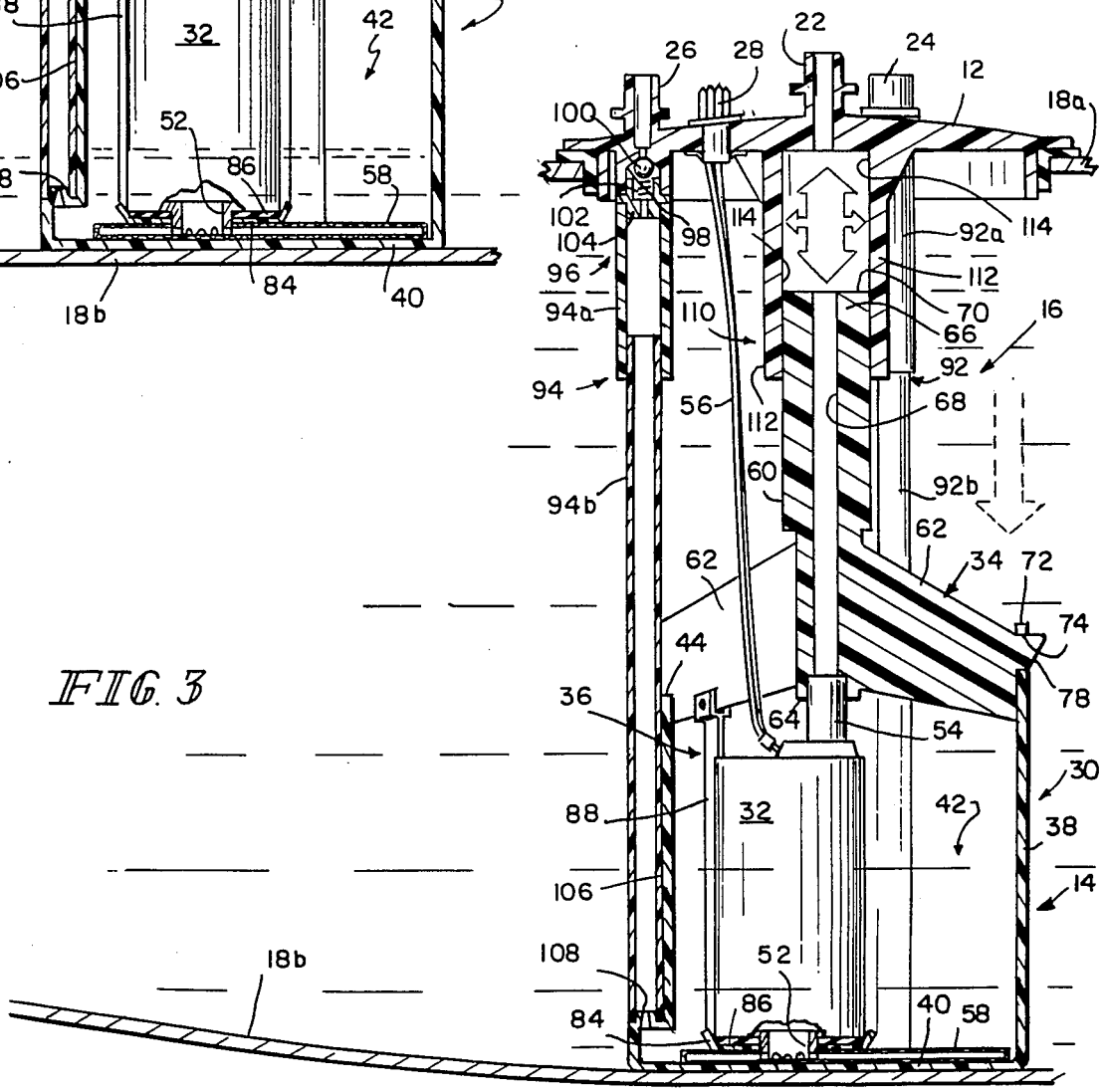
FIG. 3 is a view similar to the view in FIG. 2 showing the fuel sender unit biased against the bowed bottom wall of a deformed fuel tank.

Fuel pump 32 includes a pump inlet 52 desirably formed in a bottom wall thereof and a pump outlet 54 desirably formed in a top wall thereof as best shown in FIGS. 2 and 3. For example, a suitable fuel pump is available from Walbro Corporation. Illustratively, fuel pump 32 is an electric pump in electrical communication with an external power source (not shown) via wire harness 56 and electrical wire harness connector 28. Although an electrically powered fuel pump is preferred for reasons of economy, compactness, and ease of replacement and service, it will be understood that a variety of other known means (now shown), including, but not limited to, mechanical, hydraulic, or pneumatic pump systems, can be employed in lieu of an electric pump.

Filter 58 fits over pump inlet 52, as best shown in FIGS. 2 and 3, to provide means for preventing entry of water, sediment, or other foreign matter into fuel pump 32. Filter 58 is a discriminator of conventional construction and can be a tubular sock made of any suitable filtering media, e.g., SARAN plastics material. It is expected that filter 58 will contact bottom wall 40 in the conventional manner. As is customary, filter 58 discriminates among water, gasoline, and diesel fuel by virtue of surface tension.

Referring primarily to FIG. 1, upper and lower pump support frames 34, 36 cooperate to suspend fuel pump 32 within hollow chamber 42, thereby positioning pump inlet 52 in close proximity to bottom pump wall 40. Upper support frame 34 includes a hollow central shaft 60 and four fin members 62 extending outwardly from central shaft 60 at circumferentially-spaced intervals to as to resemble the "flight" attached to the rear end of a gaming dart shaft.

Hollow shaft 60 includes a lower end 64, an upper end 66, and a fuel-conducting discharge passage 68 extending therebetween. Lower end 64 is coupled in fluid communication to pump outlet 54. Upper end 66 provides a flat annular biasing surface 70 for converting pump pressure into a downwardly-acting biasing force, which force operates to bias the fuel sending means 14 downwardly to a lowest depth within the fuel tank 18 during operation of fuel pump 32. In effect, the fuel pump 32 generates at least a minimum pump pressure and the flat annular biasing surface and the rest of the adjacent fuel delivery assemblY 110 cooperate to provide means for using pump pressure in excess of the minimum pump pressure to bias the fuel sending means 14 downwardly and maintain the pump inlet 52 in close proximity to the bottom wall 18b. This process will be explained below in greater detail.

A "double"mounting bracket is provided at the radially outer end of each fin member 62 to couple the upper pump support frame 34 to one of four upstanding ears 72 circumferentially spaced about the upper annular edge 44 of the reservoir cup 30 and extending upwardly therefrom. These four upstanding ears 72 provide mounting fixtures for the four fin members 62. Each ear 72 is formed to include a lug-receiving slot 74 and an adjacent pin-receiving aperture 76. The distal end of each fin member 62 includes a radially outwardly-extending lug 78 and an orthogonal flange 80 as shown best in FIG. 1. The radially outwardly-extending lug 78 on the double mounting bracket engages a slot 74 formed in one portion of the upstanding ear 72 while a snap-pin 82 interconnects flange 80 and another portion of upstanding ear 72. Thus, lugs 66, flanges 80, snap-pins 82, and upstanding ears 72 cooperate to provide novel "double" means for detachably mounting the upper pump support frame 36 to the reservoir cup 30. Advantageously, this arrangement is easily disassembled at service by removing and replacing snap-pins 82.

Lower pump support frame 36 includes a pump carrier dish 84 and four legs 88 depending from the upper pump support frame 36. These legs 88 interconnect the fixed fin members 62 and the pump carrier dish 84 to locate and support pump 32 in the hollow chamber 42 as shown in FIGS. 1–3. Noise insulating gasket 86 is positioned intermediate the bottom wall of fuel pump 32 and the pump carrier dish 84 to dampen noise due to operation of the fuel pump 32 or other vibration.

Guide means 16 includes three telescoping tube assemblies 90, 92, and 94 extending downwardlY in the fuel tank 18 and coupling the top mounting plate 12 and the movable fuel sending means 14 in sliding relation. The first tube assembly 90 only functions to guide relative movement of fuel sending means 14 and comprises a fixed guide sleeve **90*a* rigidly attached to the under side of mounting plate 12 and a movable guide member 90*b* slidably received within guide sleeve 90*a*** in sealed, telescoping relation.

The second tube assembly 92 provides a siphon for draining fuel tank 18. This siphon feature enhances the utility of the novel fuel sender unit 10 in that it provides a means for emptying the fuel tank 18 of fuel in the event tank 18 requires service attention when partiallY or completely filled with fuel. Drainage is desirably accomplished by a coupling in external pump (not shown) to secondary outlet 24 to pump fuel from fuel tank 18 when necessary. Particularly, the second tube assembly 92 comprises a fixed siphon tube sleeve **92*a* rigidly attached to mounting plate 12 in fluid communication with secondary outlet 24 and a movable siphon tube member 92*b* slidably received within siphon tube sleeve 92*a*** in sealed, telescoping relation.

The third tube assembly 94 provides a means for returning unused fuel from the vehicle engine (not shown) to fuel tank 18. This return tube feature is especially advantageous in vehicles having fuel injection systems Typically, a certain amount of excess fuel is not ignited in such a system and must be returned to the fuel tank for recycling. Particularly, the third tube assembly 94 comprises a fixed return tube sleeve **94*a* rigidly attached to mounting plate 12 in fluid comunicat:on with inlet 26 and a movable return tube member 94*b* slidably received within return tube sleeve 94*a* in sealed, telescoping relation. Referring particularly to FIGS. 2 and 3, a check valve 96 is provided in the fuel-conducting passageway through fixed return tube sleeve 94*a* to prevent unwanted backflow of fuel therethrough in the event a line is cut. Check valve 96 includes an axially, downwardly-facing contoured ball valve seat 98, a valve ball 100, a spring 102 yieldably biasing valve ball 100 upwardly against valve seat 98, and a retainer 104 for holding the valve ball 100 and spring 102** in proper functional positions.

Reservoir cup 30 is formed to include three guideways 106 circumferentially spaced about side wall 38. Each guideway 106 is situated to receive the lower distal end of one of the guide or tube members **90*b*, 92*b*, or 94*b*. Each of members 90*b*, 92*b*, and 94*b* are sonically welded tp a button 108 within eacch guideway 106 as shown in FIGS. 2 and 3 so as to fix those tubes to the reservoir cup 30**.

A hollow button 108 is provided at the lowermost end of the guideways 106 receiving tube members **92*b* and 94*b* to place those tubes in fluid comunication with the hollow chamber 42 in reservoir cup 30 so that fuel is returnable to and siphonable from the reservoir cup 30 via the second and third tube assemblies 92 and 94, respectively. A solid button (not shown) is suitable for use in the lowermost end of the guideway 106 receiving guide member 90*b* since the first tube assemblY 90 is, in one sense, only a "dummy" arrangement provided to aid in guiding movement of fuel sending means 14 in relation to the fixed top mounting plate 12 and need not be of hollow construction to conduct fuel therethrough. As noted above, all guide and tube members 90*b*, 92*b*, and 94*b*** are sonically welded into their proper positions.

A fuel delivery assembly 110 is disposed in a central region of the fuel sender unit 10 to couple pump outlet 54 and primarY outlet 22 in fluid communication so that fuel is pumpable from hollow chamber 42 formed in reservoir cup 30 toward a point of use outside of fuel sender unit 10. Fuel delivery assembly 110 is uniquely configured to define adjustment means for yieldably biasing the fuel sending means 14 against the bottom wall **18*a* of the fuel tank during fuel pumping activity to maximize recovery of fuel from fuel tank 18. Advantageously, the novel construction of the central fuel delivery assembly 110 enables fuel pump 32** to reach and pump fuel collecting in low-lying, sagging regions of deformed fuel tanks. In addition, such a feature enhances the flexibility of its parent fuel sending unit by providing the extensibility (i.e. downward extension capability of fuel pump therein) necessary to permit installation of a single fuel sending unit, so equipped, in a wide variety of fuel tanks of varying depths without need for additional manual depth adjustment. Thus, one versatile fuel sender unit effectively replaces the many conventional fixed-position units presently intended to function in a fuel tank of a particular size and having a certain tank depth.

Fuel delivery assembly 110 is best seen in FIGS. 2 and 3 and includes a hollow cylinder 112 formed to include a piston-receiving fuel delivery chamber 114 and a central pump support shaft 60. In addition to its pump support function, the upper end of central shaft 60 is received in delivery chamber 114 to position annular biasing surface 70 therein, and to provide, in effect, a reciprocable "piston" within hollow cylinder 112.

One function of fuel delivery assembly 110 is to conduct fuel from fuel tank 18 toward a point of use via pump outlet 54, fuel-conducting passageway 68 in central shaft 60, fuel delivery chamber 114, and primary outlet 22. Another function of fuel delivery assembly 110 is to bias the fuel sending means 14 against the bottom fuel tank wall **18*b* by converting superatmospheric pressure in the chamber 114, which pressure results from operation of fuel pump 32, into a downwardly-directed force applied to annular biasing surface 70 of the "piston-like" central shaft 60**.

In use, fuel pump 32 discharges fuel under pressure (e.g. about 40 psi; by comparison, the pressure in the return line 94 is only about 1 or 2 psi) into fuel deliverY chamber 114 via pump outlet 54 and fuel delivery passageway 68. As shown in FIGS. 2 and 3, hollow cylinder 112 is rigidly attached to mounting plate 12 and thus substantially immovable. The annular biasing surface 70 on the upper end 66 of central shaft 60 uses the pressure created in an axially-upper portion of chamber 114 to bias the fuel sending means 14 downwardly in fuel tank 18. High pressure in chamber 114 acts over the surface area of annular biasing surface 70 to apply a downwardly-directing force thereto that moves the fuel sender means 14 against the underlying bottom wall **18*b* of the fuel tank 18**.

The magnitude of the downwardly-directed force is a function of the pressure in chamber 114 and the area of surface 70. Advantageously, the fuel sending means 14 is able to move upwardly against the downwardly-directed biasing force in response to a jolt, sudden shock, or other upward movement-inducing force since no physical barrier to such movement exists in fuel delivery assembly 110. Although pressure in chamber 114 restrains upward movement of upper end 66 of the central "piston" shaft 60, it does not inherentlY prevent such movement during such a jolt or sudden shock.

The entire fuel sending means 14 moves downwardly at the same rate as "piston" shaft 60 toward bottom fuel tank wall **18*b* due to rigid interconnection with central shaft 60 via fin members 62. It will be appreciated that such movement is not hampered by any of first, second and third telescoping tube assemblies 90, 92, and 94 since those assemblies aid in guiding relative movement of the fuel sending means 14 and frame 12, 112** without obstructing such movement in any way.

Although the invention has been described in detail with reference to certain preferred embodiments, variations and modifications exist within the scope and spirit of the invention as described and defined in the following claims.

What is claimed is:

1. A fuel sender unit for delivering fuel from a fual tank having a bottom wall, the fuel sender unit comprising a support fixtures mounted on the fuel tank, sending means for pumping fuel in the fuel tank toward a point of use outside the fuel tank, the sending means being situated within the fuel tank, and extensible means for coupling the sending means to the support fixture so that said sending means is movable within the fuel tank in relation to the support fixture in response to fuel pressure generated during operation of the sending means to reach and pump fuel accumulating along the bottom wall of the fuel tank.

2. The fuel sender unit of claim 1, wherein the fuel tank includes a top wall, and the support fixture includes a mounting plate fixed in the top wall of the fuel tank.

3. The fuel sender unit of claim 1, wherein the sending means includes pump means for generating at least a predetermined minimum pump pressure, the pump means having an inlet, and pressure-sensitive means for using pump pressure in excess of the predetermined minimum pump pressure to bias the pump means downwardly to maintain the pump inlet in an operating position in close proximity to the bottom wall of the fuel tank.

4. The fuel sender unit of claim 1, wherein the sending means includes a pump unit having an inlet and accumulator means for substantially continuously supplying fuel to the pump inlet during sloshing and churning of fuel within the fuel tank induced by agitation or other upset of the fuel tank so long as the quantity of fuel in the fuel tank exceeds a predetermined minimum amount.

5. The fuel sender unit of claim 4, wherein the accumulator means includes auxiliary reservoir means for accumulating at least a predetermined quantity of fuel in a selected region within the fuel tank in fluid communication with the pump inlet to maintain a substantially uninterrupted supply of fuel at the pump inlet during operation of the pump so long as the quantity of fuel in the fuel tank exceeds the predetermined minimum amount.

6. The fuel sender unit of claim 1, wherein the sending means includes auxiliary reservoir means for providing a fuel reserve within the fuel tank to maintain a sufficient quantity of pumpable fuel in a selected region within the fuel tank for use during agitation of the fuel tank.

7. The fuel sender unit of claim 6, wherein the auxiliary reservoir means includes a reservoir cup having an upper edge establishing a maximum fill level, fuel in the fuel tank normally flowing over the upper edge to fill the reservoir cup, and fuel inlet means for admitting fuel into the reservoir cup after the crest of fuel in the fuel tank has fallen to a level below the maximum fill level established by the upper edge.

8. The fuel sender unit of claim 7, wherein the fuel inlet means is a one-way inlet valve.

9. The fuel sender unit of claim 7, wherein the reservoir cup includes a side wall and a bottom wall, and the fuel inlet means is provided in at least one of the side wall and the bottom wall.

10. The fuel sender unit of claim 1, wherein the extensible means includes adjustment means for yieldably biasing the sending means against the bottom wall to maximize recovery of fuel from the fuel tank.

11. The fuel sender unit of claim 10, wherein the sending means includes a fuel pump having an inlet and the adjustment means includes cylinder means for providing a region pressurized by the fuel pump and piston means for using pressure in said region to bias the sending means.

12. The fuel sender unit of claim 11, wherein the cylinder means includes a first hollow discharge tube extending through an aperture formed in the support fixture to conduct fuel discharged by the pump toward a point of use outside of the fuel tank, the first hollow discharge tube being formed to include a hollow chamber within the fuel tank defining said pressurizable region, and the piston means incudes a second hollow discharge tube having one end slidably received within the first hollow discharge tube in telescoping relation and the other end connected to the pump, the second hollow discharge tube including a biasing surface positioned within the hollow chamber of the first hollow discharge tube so that pressure in said region acts on the biasing surface to apply a downwardly-directed force to the slidable second hollow discharge tube to lower the pump inlet to an operating positoin in close proximity to the bottom wall of the fuel tank.

13. A fuel sender unit for delivering fuel from a fuel tank having a bottom wall that deflects under a fual load, the fuel sender unit comprising a support fixture mounted on the fuel tank, sending means for pumping fuel in the fuel tank toward a point of use outside the fuel tank, the sending means being situated within the fuel tank and including a pump having an outlet, extensible means for coupling the sending means to the support fixture so that the sending means is movable within the fuel tank during operation of the sending means to reach and pump fuel accumulating along the deflectable bottom wall of the fuel tank, a fuel discharge outlet member, and discharge means for conducting fuel discharged from the pump outlet under superatmsopheric hydraulic pump pressure to the fuel discharge outlet member, the discharge means including actuation means for using the superatmospheric hydraulic pump pressure to apply a downwardly-directed biasing force to the sending means, thereby yieldably biasing the sending means substantially against the deflectable bottom wall of the fuel tank during operation of the pump.

14. The fuel sender unit of claim 13, wherein the actuation means is configured to include an interior surface having a predetermined surface area that is exposed to the super-atmospheric hydraulic pump pressure to generate the downwardly-directed biasing force.

15. The fuel sender unit of claim 14, wherein the magnitude of the downwardly-directed biasing force is a function of the size of the predetermined surface area so that the magnitude of the force increases in direct relation to an increase in the size of the predetermined surface area.

16. The fuel sender unit of claim 14, wherein the discharge means further includes a fixed hollow discharge tube rigidly attached to the fuel discharge outlet member, and the actuation means further includes a movable hollow discharge tube depending from said interior surface, a lower end of the movable discharge tube being coupled to the pump outlet and an opposite upper end being received within the fixed discharge tube in telescoping, sliding relation to position said interior surface wholly within the interior of the fixed hollow discharge tube so that the movable discharge tube is moved downwardly relative to the fixed discharge tube under the influence of the downwardly directed pump-biasing force acting on the interior surface, thereby lowering the sending means to an operating position in close proximity to the deflectable bottom wall of the fuel tank.

17. The fuel sender unit of claim 14, wherein the sending means includes auxiliary reservoir means for providing a fuel reserve within the fuel tank to maintain a sufficient quantity of pumpable fuel in a selected region within the fuel tank for use during agitation of the fuel tank.

18. The fuel sender unit of claim 17, wherein the auxiliary reservoir means includes a reservoir cup having an upper edge establishing a maximum fill level, fuel in the fuel tank normally flowing over the upper edge to fill the reservoir cup, and fuel inlet means for admitting fuel into the reservoir cup after the crest of fuel in the fuel tank has fallen to a level below the maximum fill level established by the upper edge.

19. A fuel sender unit for delivering fuel from a fuel tank having a bottom wall that deflects under a fuel load, the fuel sender unit comprising a support fixture mounted on the fuel tank, sending means for pumping fuel in the fuel tank toward a point of use outside the fuel tank, the sending means being situated within the fuel tank and including reservoir means for accumulating a reserve supply of fuel in a selected region within the fuel tank and, extensible means for coupling the sending means to the support fixture so that sending means is movable within the fuel tank in relation to the support fixture in response to fuel pressure generated during operation of the sending means to reach and pump fuel accumulating along the deflectable bottom wall of the fuel tank, the extensible means including guide means for guiding the sending means in sliding relation to the support base.

20. The fuel sender unit of claim 19, wherein the guide means including siphon means for selectively conducting fuel from the reservoir means to a point of use outside of the fuel tank.

21. The fuel sender unit of claim 19, wherein the guide means includes return means for delivering fuel to the reservoir means from an external source outside the fuel tank.

22. In a vehicle having an engine equipped with a fuel injection system, the fuel sender unit of claim 21, wherein the external source is uncombusted fuel discharged by the fuel injection system during operation of the vehicle engine, the return means functioning to return automatically excess uncombusted fuel from the vehicle engine to the reservoir means so that said uncombusted fuel is recycled.

23. The fuel sender unit of claim 19, wherein the reservoir means includes a reservoir cup having an upper edge establishing a maximum fill level, fuel in the fuel tank normally flowing over the upper edge to fill the reservoir cup, and fuel inlet means for admitting fuel into the reservoir cup after the crest of fuel in the fuel tank has fallen to a level below the maximum fill level established by the upper edge.

24. A fuel sender unit for delivering fuel from a fuel tank having a bottom wall, the fuel sender unit comprising a support fixture mounted on the fuel tank, sending means for pumping fuel in the fuel tank toward a point of use outside the fuel tank, the sending means being situated within the fuel tank and including a pump having an inlet and an outlet, extensible means for coupling the sending means to the support fixture so that sending means is movable within the fuel tank during operation of the sending means to reach and pump fuel accumulating along the bottom wall of the fuel tank, and discharge means for conducting fuel discharged from the pump outlet under superatmospheric hydraulic pressure along a fuel flow path to a location outside the fuel tank, the discharge means including cylinder means for providing a piston chamber in the fuel flow path, the cylinder means being fixed rigidly in relation to the fuel tank, and piston means for yieldably biasing the pump downwardly to maintain the pump inlet in an operating position in close proximity to the bottom wall of the fuel tank, the piston means being received in the piston chamber of the cylinder means in sealing relation to convert superatmospheric hydraulic pressure of pumped fuel in the piston chamber into downwardly-directed pump-biasing force.

25. A fuel sender unit for delivering fuel from a fuel tank, the fuel sender unit comprising a support fixture mounted on the fuel tank, sending means for pumping fuel from the fuel tank to a point of use outside of the fuel tank, the sending unit including a pump unit having an inlet and reservoir means for accumulating fuel in a selected region within the fuel tank in fluid communication with the pump inlet for maintaining a substantially uninterrupted supply of fuel at the pump inlet during operation of the pump so long as the quantity of fuel in the fuel tank exceeds a predetermined minimum amount, and guide means for guiding the sending means in sliding relation to the support fixture, the guide means including a plurality of first guide tube assemblies situated in spaced-apart relation about the periphery of the sending means at least one of the first guide tube assemblies being configured to provide telescoping means for conducting fuel between the reservoir means and a region outside of the fuel tank.

26. The fuel sender unit of claim 25, wherein the reservoir means includes a reservoir cup having an upper edge establishing a maximum fill level, fuel in the fuel tank normally flowing over the upper edge to fill the reservoir cup, and fuel inlet means for admitting fuel into the reservoir cup after the crest of fuel in the fuel tank has fallen to a level below the maximum fill level established by the upper edge.

27. The fuel sender unit of claim 26, wherein the reservoir cup includes a side wall and a bottom wall, and the fuel inlet means is provided in at least one of the side wall and the bottom wall.

28. The fuel sender unit of claim 26, wherein the at least one of the first guide tube assemblies includes a first tube connected to the support fixture and a second tube telescopically engaging the firs tube, and the second tube is coupled to the reservoir means to lie in fluid communication with the reservoir cup.

29. The fuel sender unit of claim 25, wherein one of the guide tube assemblies provides siphon means for selectively conducting fuel from the reservoir means to a point of use outside of the fuel tank.

30. The fuel sender unit of claim 25, wherein one of the guide tube assemblies provides return means for delivering fuel to the reservoir means from an external source outside the fuel tank.

31. The fuel sender unit of claim 25, wherein said at least one of the guide tube assemblies includes a first tube coupled to the support fixture and a second tube slidably received within the first tube in telescoping relation and coupled to the reservoir means to lie in fluid communication therewith.

32. The fuel sender unit of claim 25, wherein each first guide tube assembly is configured to define an interior region and the first guide tube assemblies are spaced apart to situate said individual interior regions about the periphery of the sending means in spaced-apart relation.

33. The fuel sender unit of claim 25, wherein each of the plurality of first guide tube assemblies is coupled to the reservoir means.

34. The fuel sender unit of claim 25, wherein at least one of the first guide tube assemblies includes a first tube coupled to the support fixture and a second tube telescopically engaging the first tube, and the second tube is coupled to the reservoir means.

35. The fuel sender unit of claim 25, wherein the sending means further comprises a second guide tube assembly interconnecting the pump and the support fixture for guiding vertical movement of the pump and configured to provide telescoping means for conducting fuel between the pump and a region outside of the fuel tank.

36. A fuel sender unit for delivering fuel from a fuel tank having a bottom wall to a region outside the fuel tank, the fuel sender unit comprising reservoir means for accumulating fuel in a selected region within the fuel tank, pump means for pumping fuel from the reservoir means to a point of use outside of the fuel tank, extensible means for biasing the reservoir means toward the bottom wall of the fuel tank, the extensible means including a plurality of telescoping tube assemblies slidably coupling the fuel tank and the reservoir means to guide movement of the reservoir means within the fuel tank, at least one of the telescoping tube assemblies including a fuel-conducting passageway and extending downwardly into the reservoir means to couple the reservoir means and said region outside of the fuel tank in fluid communication via said fuel-conducting passageway.

37. The fuel sender unit of claim 36, further comprising a support fixture mounted on the fuel tank, said at least one of the telescoping guide tube assemblies including a first tube coupled to the support fixture and a second tube slidably received within the first tube in sealed, telescoping relation and coupled to the reservoir means to lie in fluid communication therewith.

* * * * *

UNITED STATES PATENT AND TRADEMARK OFFICE

CERTIFICATE OF CORRECTION

PATENT NO. : 4,694,857

DATED : September 22, 1987

INVENTOR(S) : Robert S. Harris

It is certified that error appears in the above-identified patent and that said Letters Patent is hereby corrected as shown below:

At column 1, lines 14-15, please delete "plastic" and insert therefor --Plastic--;

At column 1, line 28, please delete "(";

At column 1, line 35, please delete "a" (second occurrence);

At column 4, line 41, please delete "now" and insert therefor --not--;

At column 4, line 61, please delete "to" and insert therefor --so--;

At column 5, line 7, please delete "assemblY" and insert therefor --assembly--;

At column 5, line 44, please delete "downwardlY" and insert therefor --downwardly--;

UNITED STATES PATENT AND TRADEMARK OFFICE

CERTIFICATE OF CORRECTION

PATENT NO. : 4,694,857

DATED : September 22, 1987

INVENTOR(S) : Robert S. Harris

It is certified that error appears in the above-identified patent and that said Letters Patent is hereby corrected as shown below:

At column 5, line 57, please delete "partiallY" and insert therefor --partially--;

At column 6, line 3, after the word "systems", please insert --.-- (period);

At column 6, line 25, please delete "tp" and insert therefor --to--;

At column 6, line 25, please delete "eacch" and insert therefor --each--;

At column 6, line 36, please delete "assemblY" and insert therefor --assembly--;

At column 6, line 45, please delete "primarY" and insert therefor --primary--;

UNITED STATES PATENT AND TRADEMARK OFFICE

CERTIFICATE OF CORRECTION

PATENT NO. : 4,694,857

DATED : September 22, 1987

INVENTOR(S) : Robert S. Harris

It is certified that error appears in the above-identified patent and that said Letters Patent is hereby corrected as shown below:

At column 7, line 20, please delete "deliverY" and insert therefor --delivery--;

At column 7, line 42, please delete "inherentlY" and insert therefor --inherently--;

At column 7, line 59, please delete "fual" and insert therefor --fuel--;

At column 7, line 62, please delete "fixtures" and insert therefor --fixture--;

At column 9, line 14, please delete "positoin" and insert therefor --position--;

At column 9, line 17, please delete "fual" and insert therefor --fuel--;

At column 11, line 27, please delete "unit" (first occurrence) and insert therefor --means--;

UNITED STATES PATENT AND TRADEMARK OFFICE

CERTIFICATE OF CORRECTION

PATENT NO. : 4,694,857

DATED : September 22, 1987

INVENTOR(S) : Robert S. Harris

It is certified that error appears in the above-identified patent and that said Letters Patent is hereby corrected as shown below:

At column 11, line 39, after the word "means", please insert --,-- (comma); and

At column 11, line 60, please delete "firs" and insert therefor --first--.

Signed and Sealed this

Third Day of May, 1988

*Attest:*

*Attesting Officer*

DONALD J. QUIGG

*Commissioner of Patents and Trademarks*